United States Patent [19]

Dahlgren et al.

[11] Patent Number: 4,527,479

[45] Date of Patent: Jul. 9, 1985

[54] INK REMOVAL, CIRCULATING AND DISTRIBUTING SYSTEM

[76] Inventors: Harold P. Dahlgren, 4008 Buena Vista, Dallas, Tex. 75205; James E. Taylor, 4129 Drowsy La., Dallas, Tex. 75233; Dwight W. Peters, Rte. 1, Box 50N, Grapevine, Tex. 76051

[21] Appl. No.: 583,486

[22] Filed: Feb. 29, 1984

Related U.S. Application Data

[63] Continuation of Ser. No. 288,744, Jul. 31, 1981, abandoned.

[51] Int. Cl.[3] ..... B41F 7/36; B41F 31/06; B41L 25/12

[52] U.S. Cl. ..... 101/450.1; 101/148; 101/350

[58] Field of Search ..... 101/148, 350, 351, 352, 101/363, 364, 366, 207, 208, 210, 450.1; 118/259, 258

[56] References Cited

U.S. PATENT DOCUMENTS

| | | | |
|---|---|---|---|
| 2,821,132 | 1/1958 | Brode | 101/350 X |
| 2,986,088 | 5/1961 | Chase et al. | 101/350 |
| 3,557,817 | 1/1971 | Royse | 101/148 X |
| 3,896,730 | 7/1975 | Garrett et al. | 101/364 |
| 3,926,114 | 12/1975 | Matuschke | 101/148 X |
| 3,968,770 | 7/1976 | Marrs | 101/366 X |
| 4,040,348 | 8/1977 | Gertsch et al. | 101/148 X |
| 4,233,898 | 11/1980 | Dahlgren | 101/148 |

FOREIGN PATENT DOCUMENTS

WO80/01151 6/1980 PCT Int'l Appl. .

*Primary Examiner*—J. Reed Fisher

*Attorney, Agent, or Firm*—Gerald G. Crutsinger; John F. Booth; Monty L. Ross

[57] ABSTRACT

A method and apparatus for continuously using ink and dampening fluid in a printing system includes removing ink and dampening fluid from a form roller after the form roller engages the printing plate. Mixing of the removed ink and dampening fluid to form a substantially homogeneous printing liquid is accomplished by circulating the removed ink and dampening fluid to a reservoir where it is mixed with ink in the reservoir by an auxillary blender. The homogeneous mixture is further circulated to the center of a metering nip between two rollers and flows longitudinally of the rollers at a rate to prevent separation of the dampening fluid from the ink. Unused printing ink and dampening fluid is returned to the reservoir with the ink and dampening fluid removed from the form roller.

18 Claims, 5 Drawing Figures

INK REMOVAL, CIRCULATING AND DISTRIBUTING SYSTEM

This is a continuation of application Ser. No. 06/288,744, filed July 31, 1981 (now abandoned).

BACKGROUND OF INVENTION

It is well known in the printing industry that it is extremely difficult to obtain high quality when printing certain forms, such as one-half page, combinations of screens and solids, diagonals, and the like. These forms are difficult to print because of the problems associated with "ghosting", ink starvation and accumulation, linting, or ink slinging. Some of these problems have been partially solved by the inovative inventions disclosed in Pat. Nos. 4,208,963, 4,233,898, and 4,237,785.

In U.S. Pat. No. 3,926,114 to Matuschke and U.S. Pat. No. 3,587,463 to Granger, it has been suggested that a scraping off device be positioned to engage an inking roller in a letterpress to remove the negative ink relief to thus avoid the accumulation of ink on rollers in an ink supply mechanism. In letterpress printing, ink is applied to raised image areas on a printing cylinder while recessed nonimage areas remain free of ink. However, in lithographic printing, ink and dampening fluid are applied to a planographic printing plate. U.S. Pat. No. 3,926,114 to Matuschke discloses a device in which ink and dampening fluid scraped off of a roller are passed into a separator so that the characteristics of the ink are not altered by the add mixture of dampening fluid. Thus, pure ink was metered to the form roller by the inking system, to prevent "greying" or the accumulation of excess dampening fluid within the ink supply as the ink was transferred to the inking roller.

U.S. Pat. No. 4,211,167 to Corse discloses a rod pressed under strong pressure against a soft surface carrying a layer of ink and dampening fluid, the rod forming a barrier only against the dampening fluid while allowing all the residual film of ink remaining on the inking roller to pass and return to a mass of ink in a reservoir.

The present invention provides a solution to problems encountered in separating ink and dampening fluid by permitting the emulsified ink and dampening fluid to be used again. We have discovered that if unused ink and dampening fluid are thoroughly mixed with fresh ink to form a substantially homogeneous mixture, ink and dampening fluid removed from a lithographic printing press equipped with an inker and a dampener can be removed from a form roller to prevent accumulation and remetered for application to the form roller provided the emulsified ink and dampening fluid are not kept in a confined area long enough for the ink and dampening fluid to separate.

Accordingly, it is an object of the present invention to provide an ink removal, circulating and distributing system that meters a substantially homogeneous mixture of ink and dampening fluid to a form roller for use in a lithographic printing system wherein an improved distribution system maintains the homogeneous mixture sufficiently agitated to prevent separation of the ink and dampening fluid.

Further, it is an object of the present invention to provide a substantially homogeneous mixture of printing ink and dampening fluid for use in a printing system.

It is a further object of the invention to provide a circulating system which eliminates heat build up in an ink reservoir.

A further object of the invention is to maintain a uniform viscosity consistency of an ink emulsion throughout a printing run.

A still further object of the invention is to provide apparatus to remove ink and dampening fluid from a form roller and to reapply the ink and dampening fluid to the form roller, in combination with a dampener having a hydrophilic roller adapted to deliver a metered film of dampening fluid to the form roller and to remove excess dampening fluid from the form roller.

SUMMARY OF THE INVENTION

In accordance with the invention, a printing system includes a printing plate, a single form roller engaging the printing plate and apparatus to apply ink and dampening fluid to the single form roller. The improvement comprises apparatus to remove ink and dampening fluid from the single form roller after the single form roller engages the printing plate. The ink and dampening fluid are then mixed with fresh ink to form a substantially homogeneous mixture and this substantially homogeneous mixture is then applied to the single inking form roller. A hydrophilic roller applies dampening fluid to the single form roller and removes excess dampening fluid from the single form roller.

Further, in accordance with the invention, an ink removal, circulating and distributing system comprises means for directing excess ink and water, which was left on a form roller after application to a lithographic printing plate, to a reservoir of fresh ink, mixing the fresh ink and the excess and returning the resultant conditioned, homogeneous mixture of dampening fluid and ink to a place of origin, such that the now homogeneous conditioned mixture is supplied in such an abundant quantity that it is not kept in a confined area long enough for water to separate therefrom to cause non-uniform ink pick-up or stripping of ink from printing rollers.

It has been observed that when an abundant quantity of an emulsion of water in ink remains in one given area for a period of time, either between two rollers or between a roller and a blade, that the emulsion will be squeezed and water separated therefrom to cause a resultant non-uniform pick-up of ink or ink stripping from the roller or rollers. It is therefore advantageous to limit the time that the emulsion stays in one given pressure area.

We have found that when supplying the pressure area with an excess of the emulsion, flow must be maintained such that a given quantity of emulsified ink stays in a given pressure area only a limited amount of time sufficient to allow the emulsion to pass along the pressure area, but not allow time for water to be squeezed therefrom and remain in the given pressure area to cause problems.

We have therefore been able to print continuously with a controlled emulsion of dampening fluid and ink wherein before, the emulsion supplied to the pressure area would separate into water and ink, and the water would cause non-uniform ink pick-up and stripping of ink rollers.

Other objects and advantages of the invention will become more apparent upon reading the following detailed description and upon references to the drawings.

BRIEF DESCRIPTION OF THE DRAWINGS

Drawings of three embodiments of the invention are annexed hereto wherein like reference characters are used throughout to designate like parts, in which.

DESCRIPTION OF THE INVENTION

Figure 1:
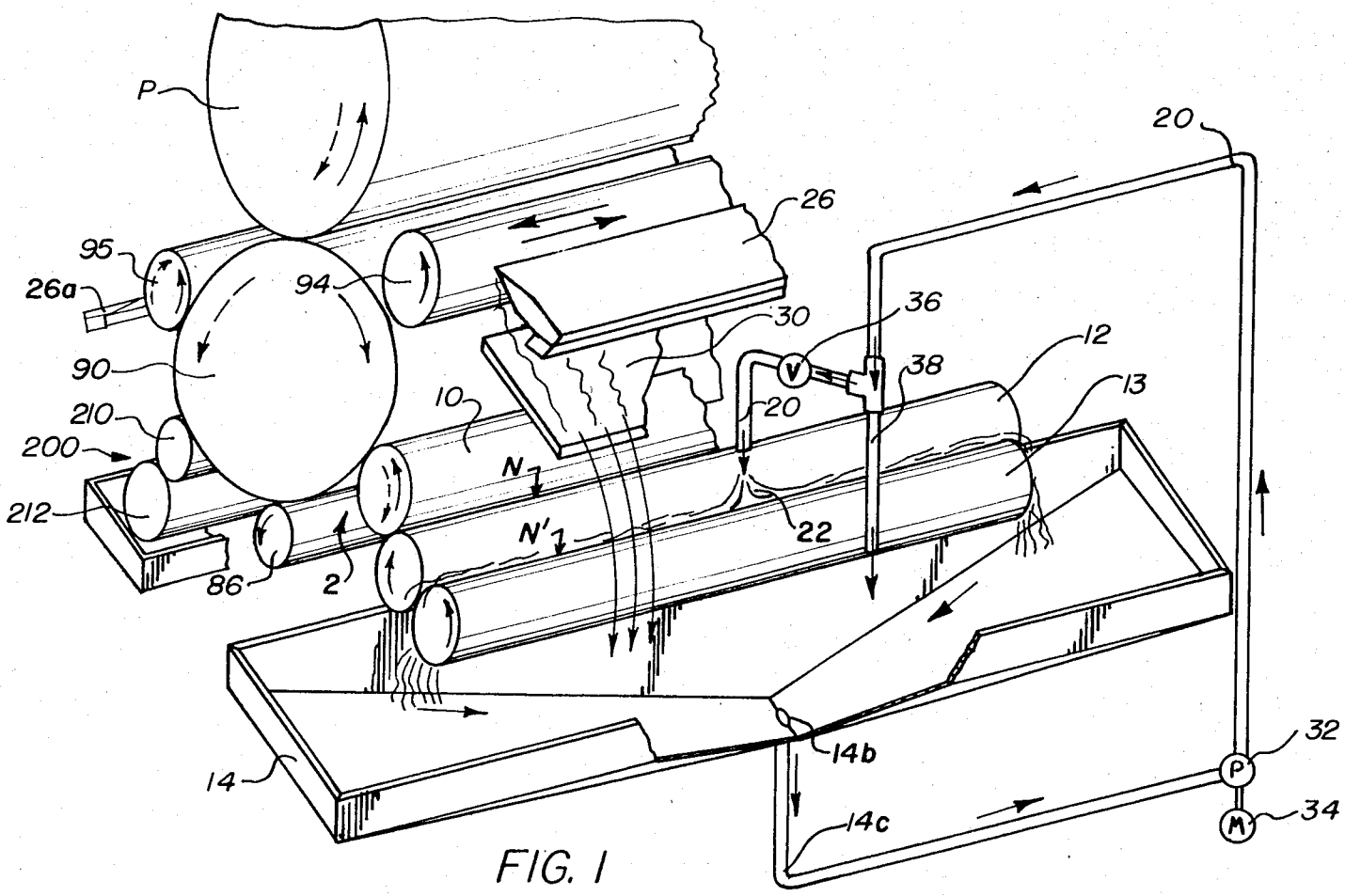
FIG. 1 is a fragmentary diagrammatic perspective view of a first embodiment of the invention.
Figure 2:
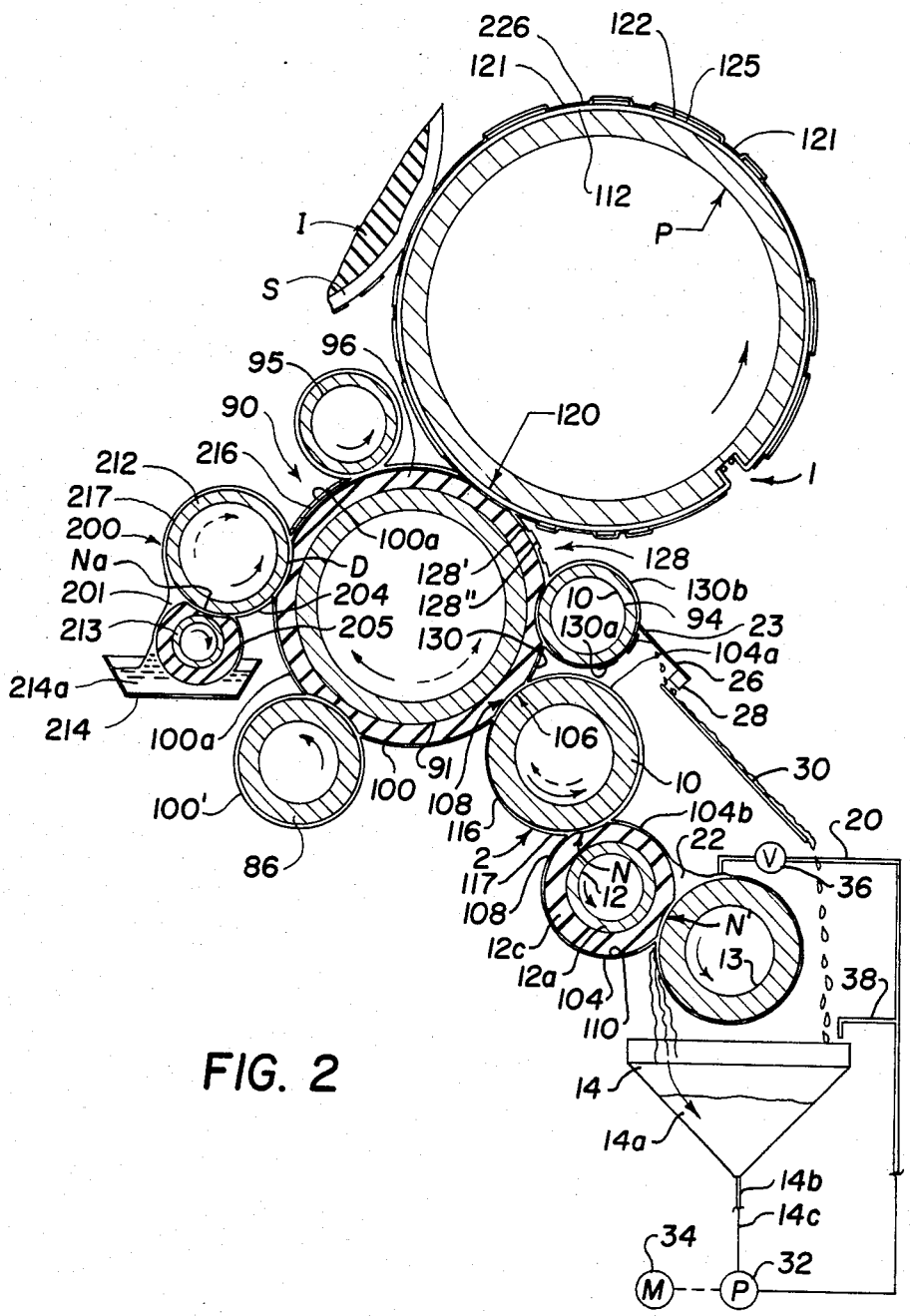
FIG. 2 is a diagrammatic illustration of an inking system constructed according to the present invention as used with a newspaper printing system with the various films of ink and dampening fluid being illustrated.

A printing system 1 is illustrated in FIGS. 1 and 2 which includes an inking system 2, a scraping-off means 26, a reservoir 14, a pump 32 and motor 34, by-pass line 38, a distributor line 20 and nip N′ between two adjacent rollers 12 and 13 in pressure indented relation and a suitable dampener 200.

Ink is supplied to nip N′ via ink distributor line 20 to the mid-point between ends of rollers 12 and 13 in an abundant quantity such that the excess flows towards the roller ends and cascades therefrom to be collected and supplied to reservoir 14 by gravity feed. Blended in reservoir 14 with ink, the mixture or emulsion of ink and dampening fluid removed from form roller 90 by roller 94 and scraping-off means 26 is pumped back to distributor line 20 to complete the circuit. By-pass 38 is provided to enable pump 32 to run at a high rate of speed to thoroughly mix and circulate the emulsion further. Pump 32 is preferably a constant displacement auger-type screw pump driven by a variable speed air motor 34. Pump 32 and by-pass 38 provide adequate mixing through circulation to form and maintain a homogeneous mixture of the ink and dampening fluid.

Water and ink excess 128 left on the form roller 90 of the inker 2, after printing, is applied to roller 94 and wiped off by scraping off means 26. This non-uniform mix of water and ink is then preferably moved to reservoir 14 and through pump 32 where it is thoroughly mixed with fresh new ink and/or previously conditioned ink before returning to distributor tube 20. The dampener 200 is of the general form roll contact-type disclosed in the U.S. Pat. No. 3,168,037, entitled "Means For Dampening Lithographic Offset Printing Plates" which issued Feb. 2, 1965 to Harold P. Dahlgren. The disclosure of U.S. Pat. No. 3,168,037 is incorporated herein by reference in its entirety for all purposes.

The inker generally comprises a form roller 90, ink idler roller 10, ink transfer roller 12, ink metering roller 13, and ink pan 14. Form roller 90, ink idler roller 10 and ink transfer roller 12 are generally supported between side frames (not shown) as disclosed in PCT International Application No. 79/00948 filed June 3, 1980, entitled "Inker For Newspaper Press", the disclosure of which is incorporated herein by reference in its entirety for all purposes.

Suitable means are provided, as hereinbefore described, for delivering an abundant supply of ink to the ink metering nip N′ between adjacent surfaces of ink metering roller 13 and ink transfer roller 12. In the particular embodiment of the invention illustrated in FIG. 1, a distribution tube 20 discharges a substantially homogeneous printing liquid 22 at the junction between rollers 12 and 13 with the liquid being metered at ink metering nip N′ and carried by the surface of roller 12 to thereby provide ink at ink transfer nip N. A sufficient flow of liquid 22 is provided at the junction of rollers 12 and 13 to maintain a flow of excess liquid over the ends of rollers 12 and 13 into ink pan 14, as will be hereinafter more fully explained.

Idler roller 10 and metering roller 13 are preferably hard and have an exterior surface which may be smooth or textured and which are ink receptive or oleophillic, such as copper or plastic. The surface of ink idler roller 10 and ink metering roller 13 may be either hard or resilient, depending upon the characteristics of the surface of form roller 90. If the form roller 90 has a resilient surface, then the surfaces of the idler roller 10 and metering roller 13 are preferably hard.

Transfer roller 12 preferably comprises a hollow tubular sleeve **12*a* with a resillient cover 12*c* secured about the outer surface of the sleeve. This cover material of ink transfer roller 12** is selected so as to be oleophillic and the surface may be textured.

It should be readily apparent that if desired, the material of idler roller 10, ink transfer roller 12 and ink metering roller 13 may be alternately hard and soft.

Ink idler roller 10 is preferably positioned in pressure indented relationship with form roller 90, which has a metal tubular core 91 as described in U.S. Pat. No. 4,233,898.

Form roller 90 has a smooth outer cover 96 which may be non-absorbent or absorbent, hard or soft, depending upon the nature of construction of printing plate 112.

In one embodiment, form roller 90 has a smooth outer cover 96 which may have a resillient non-absorbent surface. Another embodiment of form roller 90 includes a resillient surface and has a molleton type of cover which absorbs the ink and will reject dampening fluid. However, if plate 112 has raised image areas and is constructed of resilient material, form roller 90 could be provided with a hard surface of, for example, copper or a hard thin plastic covering.

Ink roller 94, preferably a traversing oscillating idler roller with associated scraping off-means 26, is adapted to remove excess ink from areas 128″ from ink film 128 on the surface of form roller 90 and transfer some of the ink to depleted areas 128′ thereby creating a more uniform film of ink 130 on the surface of roller 90 moving from nip 120 towards nip 106 to be later explained more fully.

A second ink roller 95, similar to roller 94, is positioned between plate cylinder P and dampener 200 to smooth the ink film upon reversal of form roller 90 as will be more hereinafter fully explained.

A material conditioning roller 86, preferably an oscillating idler roller, is rotatably supported as disclosed in U.S. Pat. No. 4,233,898. Roller 86, 94 and 95 are mounted in pressure indented relation with form roller 90 each having a surface of preferably similar material to that of form roller 90 such that the surface has the same affinity for ink as does the surface of form roller 90.

As the ink film 100 emerges from nip 106 between form roller 90 and idler roller 10, it may be slick and calendared. A slick film of ink is not particularly receptive to dampening fluid since the surface tension of the molecules of ink may reject the thin layer of dampening fluid to be applied by dampener 200. Material conditioning roller 86 will receive a portion of the film 100 of ink thus splitting the film 100 of ink and producing a film 100' on roller 86 thus leaving film **100*a* with a matte finish having microscopic cavities or indentations. The matte surface upon film 100*a* will readily accept the thin film 204** of dampening fluid.

Rollers 86, 94 and 95 are preferably provided with drive means (not shown) to oscillate the rollers in a longitudinal direction. Suitable oscillator drive means are well known to persons skilled in the printing art and further description is not deemed necessary. Rotation is provided through friction contact with adjacent surfaces.

Dampener 200 is diagrammatically illustrated in FIG. 2 and comprises a hydrophillic transfer roller 212 and a resilient metering roller 213 mounted in a manner similar to inker 2 as described in U.S. Pat. No. 3,168,037. Metering roller 213 meters dampening fluid **214*a* from pan 214 onto transfer roller 212 through flooded nip Na. Water film controlled by pressure between rollers 213 and 212 forms a thin layer of dampening fluid 204 which is metered through dampening fluid transfer nip D onto the matte finish of ink film 100*a* on the surface of form roller 90**.

Dampener metering roller 213 is driven by a variable speed reversible motor as described in U.S. Pat. No. 4,233,898.

For the purpose of graphically illustrating the function and results of the process of the mechanism hereinbefore described, a diagrammatic view of idler roller 10, transfer roller 12, metering roller 13 and form roller 90 is shown in FIG. 2. Ink and water films are exaggerated for clarity.

Metering roller 13 is rotatably mounted in pressure indented relation with transfer roller 12 and transfer roller 12 is rotatably mounted in pressure indented relation with idler roller 10. The pressure between adjacent roller surfaces is adjusted such that the surface of metering roller 13 and idler roller 10 are actually impressed into the surface of transfer roller 12.

At the point of tangency, or cusp area between rollers 12 and 13, an excess 22 of ink is piled up. The greatness of the excess of ink extending longitudinally of rollers 12 and 13 is regulated by virtue of the fact that excess ink will cascade over opposite ends of the transfer roller and metering roller into pan 14 by gravity to virtually create a "waterfall" of ink at opposite ends of the nip between adjacent surfaces of rollers 12 and 13, and by virtue of the amount of flow of liquid 22 from discharge tube 20. The excess of ink 22 in the flooded nip becomes the reservoir from which ink is drawn by transfer roller 12. As rollers 12 and 13 rotate in pressure indented relation, a layer of ink is metered between adjacent surfaces of the two rollers separated by a thin lubricating layer of ink. Since transfer roller 12 has a smooth, oleophillic surface thereon, a portion of the film adheres to the surface of roller 12 to form a film 104, the remaining portion being rotated on the surface of roller 13 back into the excess. A film of ink 104 is distributed on the surface of transfer roller 12 by reason of the rotating, squeezing action between rollers 12 and 13 at their tangent point at ink metering nip N' The film of ink 104 rides on the surface of transfer roller 12 and comes in contact with ink film 116 on idler roller 10 at ink transfer nip N to form a film of printing ink 104a on idler roller 10.

The film of ink 104a rides on the surface of idler roller 10 and comes in contact with a uniform film 130 of ink on form roller 90 at the inking nip 106 between idler roller 10 and form roller 90.

It is important to note that idler roller 10 may or may not be positively driven. If positively driven, it may be driven at a fixed ratio slower than the surface speed of the adjacent form roll 90. In any event, the surface of idler roller 10 is driven in the same direction as the adjacent surface of form roller 90. Idler roller 10 serves as an intermediate applicator roll between form roller 90 and transfer roller 12.

At nip 106 and N, it will be observed that idler roller 10 is impressed into the resilient surface of form roller 90 and transfer roller 12 and that the film of ink 104 has an outer surface 108, which contacts ink film 116, and an inner surface 110 which adheres to the surface of transfer roller 12. The outer surface 108 of film 104 and the outer surface 117 of the film of ink 116 on idler roller 10 are urged together to create a hydraulic connection between rollers 12 and 10 as they rotate in close relationship, but there is no physical contact between the roller surfaces. It is an important fact to note that the relatively thick film of ink 104 permits rollers 12 and 10 to be rotated at different surface speeds. Preferably, the form roller 90, which is normally press driven and rotated at the same surface speed as the printing plate 112 is rotated at a greater surface speed than the surface speed of roller 12. By regulating the differential surface speed between transfer roller 12 and form roller 90 the amount of ink applied to plate 112 may be regulated.

Within limits, if the surface speed of transfer roller 12 is increased, the ink film 104 is presented at the inking nip N at a faster rate and more ink is transferred by the surface of roller 90 to lithographic printing plate 112, and the opposite is true, if the surface speed of roller 12 is decreased.

The film of ink 104, existent between adjacent surfaces of rollers 12 and 10, permits the rollers 12 and 10 to be rotated at different surface speeds in sliding relationship because the film of ink 104 actually provides lubrication which permits slippage between adjacent surfaces of rollers 12 and 10 without frictional deterioration. By reason of the slippage between rollers 12 and 10, the ink film 104 is calendared, smoothed out, metered and distributed by shearing the ink between adjacent surfaces of roller 12 and the film 116 on idler roller 10, to create a printing liquid film 104a. The thickness of printing liquid film 104a is controlled by the relative pressures between metering roller 13 and transfer roller 12, and idler roller 10 and the relative speeds of rollers 12 and 10.

Transfer roller 12 preferably is driven at a surface speed which is within a range of for example, several hundred feet per minute slower than the surface speed of form roller 90. For example, if a printing press has paper traveling therethrough at a surface speed of 900 feet per minute, the surfaces of printing plate 112 and form roller 90 will ordinarily have a surface speed of 900 feet per minute. The surface speed of transfer roller 12 would preferably be less than 90 feet per minute.

Films 104 and 116 will be combined at inking nip N and will split when sheared as rollers 12 and 10 rotate away from inking transfer nip N. The fresh film 104*a* of printing ink adheres to the surface of idler roller 10. Ink rejected by idler roller 10 forms a feedback film 104*b* of ink which may be slightly irregular. Film 104*b* adheres to the surface of transfer roller 12 and is conveyed back to the ink metering nip N′ to be remetered. Feedback film 104*b* may not be uniform because the starved areas on form roller 90 and consequently idler roll 10, from which ink was removed by image areas on plate 112, removed different quantities of ink from film 104 in order to form film 100 on form roller 90. Film 128 has starved areas 128′ from ink removed by image areas 122 on plate 112, thus rendering film 128 irregular.

Actually ink film 130 generated at nip X is quite uniform and consequently films 100 and 116 and 104*a* and 104*b* resulting therefrom will be substantially uniform as explained later herein.

The lithographic printing plate 112 has hydrophillic or water liking non-image areas 121 and oleophillic, ink receptive, image areas 122 formed on the surface thereof. If printing plate 112 is provided with raised image areas, the dampener 200 would not be required to prevent transfer of ink to non-image areas.

At the nip 120 between applicator roller 90 and printing plate 112, the combined film 216 and 100*a* is split to form thin films 125 of ink and dampening fluid over oleophillic surfaces 122 on the printing plate. The layer 216 of dampening fluid is carried on and in the film 100*a* of printing liquid and is also distributed to form a thin film 226 of dampening fluid over hydrophillic areas 121 of the printing plate.

Some dampening fluid remains on the surface of form roller 90 which is moving away from nip 120 towards nip X, but such dampening fluid as does remain thereon is transfered with the excess liquid film 128 to become liquid film 130*a* on the ink roller 94. A doctor blade 26 has one of its edges supported by holder 28 and a second edge engaging roller 94 for removing as much of the excess liquid from the roller as possible thereby forming a uniform and thin film 130*b* on roller 94. The removed dampening fluid and ink (liquid) is gravity fed onto a deflector shield 30 which in turn permits gravity feed into a liquid reservoir 14*a* in ink pan 14.

The non-uniform excess liquid film 128 remaining on form roller 90 is combined with the ultra thin uniform film 130*b* on ink roller 94 and actually "printed" onto roller 94. Explained again, the excess ink and dampening fluid 128 remaining on the surface of form roller 90, after printing to the lithographic printing plate 112, is virtually entirely removed therefrom by transferring or "printing" the irregular film 128 to the ultra-thin doctored film 130*b* on the surface of idler roller 94. The ultra-thin and uniformly doctored film 130*b* is formed from a reservoir 23 of accumulated excess ink 130*a*. Idler roller 94 now functions as an endless doctoring surface which allows the film 128″ to be completely transferred to the surface of roller 94 just as ink film 100*a* was initially transferred or "printed" to the plate 112.

The layer of dampening fluid 216 is applied in substantially the same manner as the ink film 100 is applied. An excess of dampening fluid 214*a* is supplied to bead 201 and metered at Na between rollers 213 and 212 to form a film 204 of dampening fluid which is applied to ink film 100*a* on form roller 90 at nip D. The film 204 of dampening fluid on hydrophilic dampening fluid transfer roller 212 and dampening fluid in film 100*a* combine at nip D to form film 216 on form roller 90. The film 217 of excess dampening fluid is removed from form roller 90 and is returned to bead 201 to be remetered at nip Na.

From the foregoing it should be readily apparent that the improved apparatus for applying ink to printing systems offers control of metering at ink metering nip N and N′ to provide a film 100 of ink of precisely controlled thickness by adjusting pressure between rollers 10, 12 and 13, and futher by controlling surface speeds of rollers, 12 and 10 relative to each other. The rate at which the metered film 104 of ink is offered to film 116 on idler roller 10 at inking nip N and also the hydraulic force of obtaining the desired film split are controlled.

To eliminate conditions which could cause accumulation of ink, when printing unusual forms or on only one-half of a web, rendering it impossible to form a film 100 of precisely controlled thickness, the doctor blade 26 engages roller 94 to remove as much as possible of the ink and dampening fluid in film 128. When roller 94 engages roller 90 a thinner uniform thickness of printing liquid 130 moves into nip 106 and thereby assists in preventing an accumulation on idler roller 10.

As best seen in FIGS. 1 and 2, the mixture of dampening fluid and ink thus removed by doctor blade 26 is fed by gravity onto deflector shield 30 and from there into ink pan 14. Ink pan 14 has a central drain outlet 14*b* located in the center of pan 14, which communicates through appropriate pipes 14*c* and pump 32, driven by motor 34, to distributor tube 20 to regulate the flow of printing liquid onto metering roller 13 at 22. The provision of the bottom in pan 14 with sections sloping downwardly toward the central opening assures constant circulation of ink 14*a* in the pan. The ink flows from tube 20 into the center of nip N′ forming excess 22 and then flows outwardly along nip N′ to cascade over the ends of metering roller 13 and transfer roller 12 into opposite ends of pan 14. Thereafter, the ink is mixed with the contents of the reservoir including the non-uniform mix of ink and dampening fluid removed from roller 94. A bypass line 38 is branched from distributor tube 20 to discharge printing liquid into ink pan 14. Thus, by continuous operation of pump 32, a substantially homogeneous mixture of ink and dampening fluid is provided as printing liquid 22 and deposited onto metering roller 13 and/or transfer roller 12.

Tests have revealed that when printing at 900 feet per minute using a two plate wide lithographic newspaper press, approximately one-thirtieth gallon per minute of letterpress-type ink was printed onto a web which was thirty inches wide. The plate printed directly to the web.

The pump 32 delivered two gallons per minute of a homogeneous mixture of ink and dampening fluid through line 38 to reservoir 14 and three gallons per minute through distributor tube 20 to the nip N′. Thus, the pump capacity was five gallons per minute which was sufficient to maintain a homogeneous mixture of ink and dampening fluid. The flow of three gallons was sufficient to prevent separation of dampening fluid from ink in nip N′ or to remove any dampening fluid from nip N′ that was separated from the ink. Thus, dampening fluid was not present in nip N′ in a form which would displace ink and cause stripping.

Figure 3:
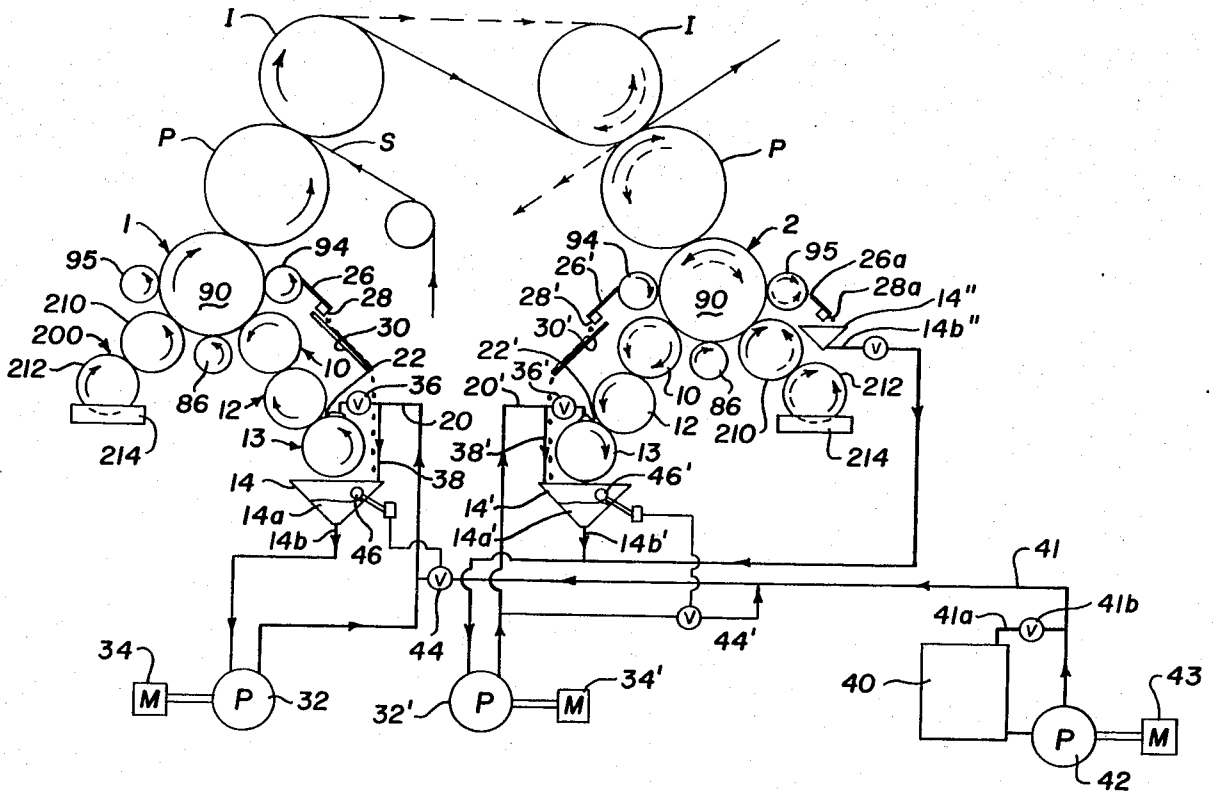
FIG. 3 is a diagrammatic illustration of an ink removal, circulating and distributing system constructed according to the present invention.

To replenish the printing liquid used in the system, an ink supply tank 40, FIG. 3, is provided in the circulating system with a pump 42 having an inlet in communication with the fresh ink and an outlet in fluid communication through line 41 with a float valve 44 which permits communication with distribution tube 20. Float valve 44 is controlled by a float 46 disposed within ink pan 14 to add fresh ink to liquid 14*a* when the level of liquid drops below a predetermined quantity. Since float valve 44 is closed except when the level of ink in pan 14 is low, a return line 41*a* having a valve 41*b* therein extends between ink supply line 41 and ink container 40 to permit circulation of ink from pump 42 through supply line 41 and return line 41*a* when float valve 44 is closed.

Further, when desired, this circulation system is operable on a complete printing couple as shown in FIG. 3. When employed in forward printing couples, the first printing unit is operable as previously described in relation to the embodiment of the invention shown in FIG. 1.

Further, for an adjacent couple in the forward printing mode only, a doctor blade 26 supported by holder 28' is disposed to engage roller 94 to remove a portion of the ink and dampening fluid film carried thereon. This portion of ink is then gravity fed through deflector shield 30' into ink pan 14'. Pan 14' includes an outlet 14*b'* which is in fluid communication through appropriate piping with pump 32' powered by motor 34' which discharges into distributor tube 20'. A control valve 36' is provided to control the flow of homogeneously mixed printing liquid 22' onto meter roller 13 for application to form roller 90 and from there onto printing cylinder P. Pump 32' is continuously supplying printing liquid through distributor tube 20' and the printing liquid is then either discharged onto metering roller 13' or through bypass tube 38' to thereby provide a continuous circulation of the printing liquid which creates the homogeneous mixture of ink and dampening fluid for discharge as the printing liquid 22'.

In the event that the second printing couple is used in a reverse printing mode only, doctor blade 26' is disengaged from roller 94 and a doctor blade 26*a* is supported by holder 28*a* for removing a portion of the ink and dampening fluid carried by roller 95. This removed portion of ink and dampening fluid is gravity fed to an ink collection pan 14'' which has a discharge outlet 14*b''* in fluid communication through appropriate piping with discharge outlet 14*b'* and the inlet of pump 32'.

A float control valve 44' is provided with an inlet in fluid communication with the outlet of a pump 42 driven by motor 43 and an outlet in communication with distributor tube 20' so that fresh ink may be added to the system when necessary. Valve 44' is controlled by a float 46' mounted within ink pan 14' so that when the level of liquid 14*a'* drops below a predetermined amount, fresh ink is supplied to the system. This arrangement permits the adding of fresh ink to the system for both forward and reverse printing by use of a single float control valve controlling the addition of fresh ink.

It should be noted that when reversing a printing couple the direction of rotation of roller 90 and, therefore, roller 10 is reversed although the directions of rotation of rollers 13 and 12 may remain the same.

Figure 4:
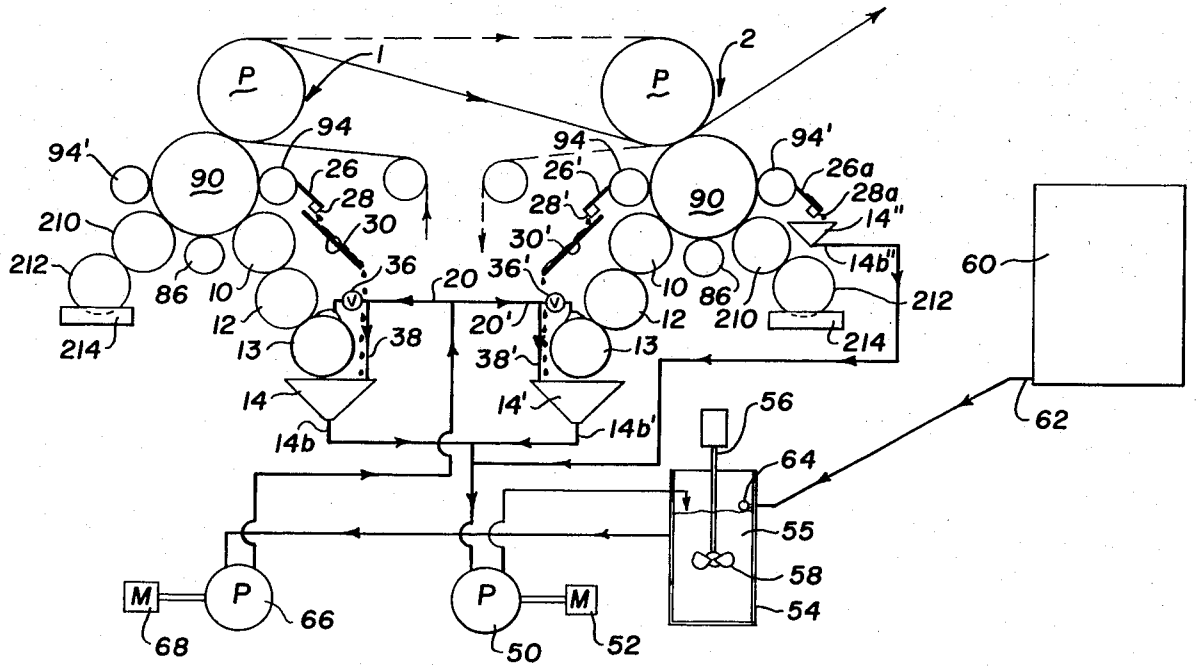
FIG. 4 is a diagrammatic illustration of a second embodiment of an ink removal, circulating and distributing system constructed according to the present invention.

A second embodiment for multiple printing couples 1 and 2 is shown in FIG. 4. This embodiment is similar to the embodiment shown in FIG. 3, except that a single pump 50 driven by motor 52 has its inlet in fluid communication through conduits or similar piping with the outlets of pans 14, 14' and 14''. The outlet of pump 50 is in fluid communication through conduits or similar piping through a mixing tank 54 which receives, mixes and stores a quantity of the printing liquid. Stirring apparatus 56 having paddles 58 disposed within the printing fluid 55 continuously mixes the fluid to ensure a homogeneous mixture of ink and dampening fluid for the printing liquid used in the printing system.

A quantity of fresh ink is stored within tank 60 which includes an outlet 62 in fluid communication through appropriate piping to a float valve 64 disposed in fluid communication within tank 54 to add fresh ink to the printing liquid 55 when needed. A second pump 66 driven by motor 68 includes an inlet in fluid communication through appropriate piping with the interior of tank 54 and outlet in fluid communication through appropriate discharge tubes 20 and 20'.

In this embodiment, pump 66 has a discharge sufficient to provide the required amount of flow of printing liquid to metering rollers 13 and 13' with some flow through bypass tubes 38 and 38' into ink pans 14 and 14', respectively. Further, this embodiment in addition to a single pump moving the homogeneous printing liquid to both metering rollers 13 and 13', includes a separate and distinct mixing apparatus to ensure that the ink and dampening fluid is continuously mixed to provide a homogeneous mixture of printing liquid 55.

Figure 5:
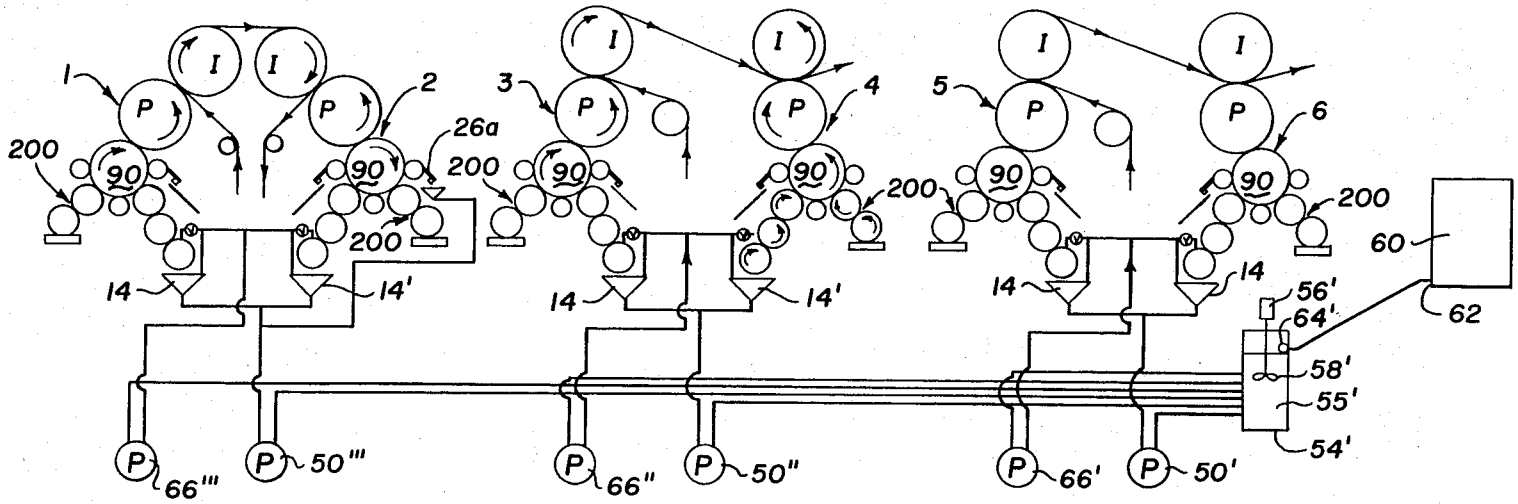
FIG. 5 is a diagrammatic illustration preferred embodiment of a multi-unit newspaper printing system incorporating the ink removal, circulating and distributing system of FIG. 4.

The third embodiment of the invention illustrated in FIG. 5 is preferred for multiple printing units which incorporates the system and described in relation to the second embodiment illustrated in FIG. 4.

In this embodiment, six printing couples 1–6 (three printing units) are illustrated with the first printing unit being capable of forward and reverse printing. It will be noted that couple 2 is illustrated with blade 26*a* positioned for reverse printing.

As illustrated, a single tank 54' is provided for receiving a quantity of printing liquid 55' therein. Mixing apparatus 58' is then used for continuously mixing the ink and dampening fluid contained within the mixing tank 54' to ensure a homogeneous mix of printing liquid from removed ink and dampening fluid from a multiple of printing units. Further, a remote supply tank 60' is provided for supporting a quantity of fresh ink and an outlet 62' is in fluid communication through appropriate piping to a float valve 64' disposed within tank 54' for adding the fresh ink into the printing liquid 55' when necessary.

Each printing unit shown in FIG. 5 is then in fluid communication through appropriate piping to return and supply pumps in a manner similar to that previously described in relation to the embodiment illustrated in FIG. 4.

In this embodiment, varying combinations of printing, having varying mixes of excess ink and dampening fluid; namely, couples running forward and reverse, couples running half-webs and those having ordinary and extraordinary printing formats, are joined together by removal of excess ink and dampening fluid from respective form rolls of each printing couple, circulated and mixed with fresh ink to form a homogeneous mixture of printing liquid and then distributed back to each printing unit.

Extensive testing has revealed that at no time was "greying" noticed throughout the period of test runs which lasted several hours and ink used on one day could readily be used again. It was seen that emulsification in printing is not a detriment when controlled as described herein. Dampening fluid when properly dispersed in ink had shown that it can be beneficial and not a contaminant to the lithographic printing process.

It should be appreciated that filters could easily be added to this system for removal of foreign particles of dried ink, dust paper lint, etc. which if allowed to accumulate could cause problems in addition to those primarily solved by this invention. The system also readily provides that ink additives and ink heating and/or cooling may be incorporated for any purpose required, primarily at tanks 54 or 54'.

It should be appreciated also that other and further embodiments of the invention may be devised without departing from the basic concept thereof.

The invention having been described, what is claimed is:

1. A method of applying an emulsified printable mixture of ink and dampening fluid to a lithographic printing plate comprising the steps of: depositing an excess of the emulsified mixture of ink and dampening fluid in a central portion of a nip between a transfer roller and a metering member such that the emulsified mixture flows longitudinally of the nip toward opposite ends of the transfer roller; rotating the transfer roller to meter a thin film of the emulsified mixture between the metering member and the transfer roller onto the surface of the transfer roller; delivering the film from the transfer roller to the lithographic printing plate; maintaining flow of the mixture longitudinally of the nip to prevent accumulation of the dampening fluid adjacent said nip; causing the mixture to cascade over opposite ends of the transfer roller into opposite ends of a reservoir to remove the mixture from the nip adjacent opposite ends of the nip; depositing ink and dampening fluid remaining in a portion of the film of ink and dampening fluid which is not accepted by the lithographic printing plate into the reservoir; pumping the mixture which has cascaded over ends of the transfer roller and the portion not accepted by the printing plate from a central portion of the reservoir to form a homogeneous mixture and to deposit the homogeneous mixture in a central portion of the nip between the transfer roller and the metering member to circulate ink longitudinally of the nip and at a rate sufficient to prevent accumulation of dampening fluid separated from the ink in the nip as a result of pressure between the transfer roller and the metering member.

2. The method of claim 1 wherein the step of pumping the mixture comprises the steps of: pumping a portion of the mixture through a first line to a central portion of the nip; and pumping a portion of the mixture into the reservoir such that the mixture is removed from the reservoir at a faster rate than it is deposited in the central portion of the nip.

3. The method of claim 2 with the addition of the steps of: delivering fresh ink to the reservoir to replenish the mixture applied to the lithographic printing plate.

4. The method of claim 1 wherein the step of removing the mixture from a central portion of the reservoir comprises: removing mixtures from a central portion of a plurality of reservoirs which supply ink to different printing plates; mixing the mixtures to form a homogeneous mixture; and pumping the homogeneous mixture to central portions of a plurality of nips.

5. The method of claim 1 with the addition of the step of: maintaining a small volume of ink and dampening fluid in the reservoir; and pumping fresh ink into the reservoir when the level of the mixture of ink and dampening fluid falls below a predetermined level.

6. The method of claim 1 with the addition of the step of: adjusting the rate at which the mixture is pumped from a central portion of the reservoir to assure that flow longitudinally of the metering nip and toward the center of the reservoir is sufficient to prevent separation of dampening fluid from ink in the metering nip and to maintain a substantially homogeneous mixture of ink and dampening fluid in the reservoir.

7. In a printing system having a printing plate, a form roller engaging the printing plate, and apparatus to apply ink and dampening fluid to the printing plate, the improvement comprising: an ink transfer roller; an ink metering roller; means urging said ink transfer roller and ink metering roller into pressure indented relation to form a nip; means metering ink from the surface of the transfer roller onto the surface of the form roller; dispensing means for delivering ink into a central portion of said nip such that ink flows longitudinally of the nip in opposite directions and cascades over opposite ends of said transfer roller and metering roller; means for removing a mixture of excess ink and dampening fluid from said form roller after said form roller engages the printing plate; a collection reservoir positioned to receive ink cascading over ends of said rollers into opposite ends of the collection reservoir and to receive the mixture of ink and dampening fluid removed from said form roller; means removing ink from a central portion of said collection reservoir; means sensing the level of ink in the collection reservoir; means to add fresh ink to ink in the collection reservoir when the level of ink in the collection reservoir falls below a predetermined level; and pump means between the means removing ink from a central portion of the collection reservoir and said dispensing means, said pump means having sufficient capacity to circulate ink longitudinally of said nip at a rate sufficient to prevent accumulation of dampening fluid in said nip and sufficient to mix ink cascading over ends of said rollers with fresh ink periodically added to the collection reservoir and the mixture of excess ink and dampening fluid removed from the form roller to assure that a substantially homogeneous mixture of ink and dampening fluid is dispensed into the central portion of the nip.

8. The system of claim 7 with the addition of variable speed drive means drivingly connected to said pump means.

9. The system of claim 7 where said means for removing a mixture of excess ink and dampening fluid from said form roller comprises: an ink removal roller urged into pressure indented relation with said form roller; and a doctor blade scraping ink and dampening fluid off of said ink removal roller.

10. The system of claim 9 with the addition of: a deflector shield positioned to permit gravity feed of excess ink and dampening fluid from said doctor blade to said collection reservoir.

11. The system of claim 7 said pump means comprising a positive displacement pump.

12. The system of claim 11, said positive displacement pump comprising: an auger-type screw pump.

13. The system of claim 7, said collection reservoir comprising: a pan having an inclined bottom sloping towards said means removing ink from a central portion of said collector reservoir.

14. The system of claim 7, said means metering ink from the surface of the transfer roller onto the surface of the form roller comprising roller means.

15. The system according to claim 14, said roller means comprising an idler roller in pressure indented relation with said transfer roller and said form roller.

16. The system according to claim 7, said ink comprising low viscosity letter press-type newsprint ink.

17. The system according to claim 7, said means sensing the level of ink in the collection reservoir being adapted to maintain a small volume of ink and dampening fluid in a collection reservoir and to cause fresh ink to be added when the level of the small volume falls below a predetermined level.

18. The system according to claim 7 with the addition of a plurality of printing systems according to claim 7, said pump means being connected to simultaneously deposit ink into a plurality of nips, such that excess dampening fluid from one printing system will be redistributed to a plurality of printing systems.

* * * * *